US009125543B1

(12) United States Patent
Li

(10) Patent No.: US 9,125,543 B1
(45) Date of Patent: Sep. 8, 2015

(54) CONFINING STRUCTURE OF A ROTATING MOP

(71) Applicant: Ching-Ho Li, Taoyuan County (TW)

(72) Inventor: Ching-Ho Li, Taoyuan County (TW)

( * ) Notice: Subject to any disclaimer, the term of this patent is extended or adjusted under 35 U.S.C. 154(b) by 0 days.

(21) Appl. No.: 14/501,237

(22) Filed: Sep. 30, 2014

(51) Int. Cl.
*A47L 13/20* (2006.01)
*A47L 13/255* (2006.01)
*A47L 13/254* (2006.01)

(52) U.S. Cl.
CPC ..... *A47L 13/255* (2013.01); *A47L 13/20* (2013.01); *A47L 13/254* (2013.01)

(58) Field of Classification Search
CPC ..... A47L 13/20; A47L 13/254; A47L 13/255
USPC ..... 15/147.1, 172, 228, 229.6
See application file for complete search history.

(56) References Cited

U.S. PATENT DOCUMENTS 8,112,840 B2 * 2/2012 Chen et al. ..... 15/229.6
8,312,587 B2 * 11/2012 Chen ..... 15/228
8,365,341 B2 * 2/2013 Lin ..... 15/229.6
8,925,139 B2 * 1/2015 Shih ..... 15/229.1
2005/0235446 A1 * 10/2005 Eggers ..... 15/220.1
2007/0067935 A1 * 3/2007 Lin et al. ..... 15/229.6
2010/0162507 A1 * 7/2010 Lee ..... 15/228
2011/0016652 A1 * 1/2011 Chu ..... 15/228
2011/0083291 A1 * 4/2011 Lin ..... 15/147.1
2011/0247163 A1 * 10/2011 Chen ..... 15/228
2014/0033460 A1 * 2/2014 Shih ..... 15/228

FOREIGN PATENT DOCUMENTS

WO WO 2012109812 A1 * 8/2012

* cited by examiner

*Primary Examiner* — Monica Carter
*Assistant Examiner* — Michael Jennings
(74) *Attorney, Agent, or Firm* — Rosenberg, Klein & Lee

(57) ABSTRACT

A confining structure of a rotating mop has a one-piece loop on a disc thereof, at least two stopping blocks arranged on the loop, and an n-typed body of a linking element being arranged correspondingly to the surface of the loop and the bottom of each stand thereof having an engaging block corresponding to the position of the stopping blocks. When the rotating rod is perpendicular to the disc, the linking element is closely joined but movable with the engaging blocks. When the bottom of the engaging blocks cannot abut on the loop and slips, the stopping blocks fix the position by abutting on the engaging blocks for the rotating rod to rotate for dewatering by centrifugal force. When the rotating rod is leaning, the linking element is not closely joined with the engaging blocks.

5 Claims, 9 Drawing Sheets

CONFINING STRUCTURE OF A ROTATING MOP

BACKGROUND OF THE INVENTION

1. Field of the Invention

The present invention relates to a confining structure of a rotating mop, particularly to one that can ensure the rotating rod to drive the disc thereof effectively for rinsing and cleaning.

2. Description of the Related Art

A so-called telescopically rotatable mop has been disclosed in U.S. Pat. No. 8,220,101, No. 8,112,840, and No 8,291,544 invented by the present inventor, which mainly comprises a mop rod that can lengthen and shorten. When the exterior rod is displaced in linear, it adjusts the interior rod to lengthen or shorten the mop rod and rotate in single direction, so as to rotate the mop head arranged at the end of the interior rod, enabling the mop head to be dewatered in a draining basket instead of by twisting the cotton strips to dry with bare hands.

Among the patents, the U.S. Pat. No. 8,112,840 disclosed a disc rotating and positioning structure of a mop that fixes a disc with an internal rod when the mop is dewatered erectly, and rotates the disc in 360 degrees with respect to the mop rod when the mop is being used for mopping the floor at an inclined position. In addition, as shown in FIGS. 1 and 2, the U.S. Pat. No. 7,540,057 disclosed a mop assembly having therein a rotatable device and a positioning device 70 that comprises a rotation controlling device, a vertically positioning device, and a rotatable device. The vertically positioning device includes a ball and is arranged at the lower section of a stick 71, and the rotatable device is disposed above the vertically positioning device, including a covering disc 72, an I-shaped connector 75 and a cleaning element. The I-shaped connector 75 is engaged with an n-shaped connector 73, both of which are positioned by the ball; whereby the rotatable device is above the vertically positioning device, and the cleaning element at the bottom of the covering disc 72 can fit any surface for cleaning. Such structure can also be found in U.S. Pat. No. 8,365,341 and No. 8,108,961.

However, the structure described above is too complicated and—more importantly—has one defect: the wear and tear would appear on the bottom of the n-shaped connector 73 and the cover 74 of the covering disc 72 after long-term use, since the rotation of the stick 71 and the covering disc 72 is driven by the n-shaped connector 73 closely engaging the covering disc 72, therefore dewatering the strips 721. As a result, the close engagement would gradually loosen and eventually the stick 71 would not be able to rotate the covering disc 72 for dewatering, and the mop cannot function properly.

SUMMARY OF THE INVENTION

The primary object of the present invention is to provide a confining structure of a rotating mop that can ensure the rotating rod thereof to drive the disc effectively and also ensure longer durability of the present invention.

In order to achieve the object above, the present invention comprises a mop head with a disc having a plurality of cotton strips arranged on the bottom periphery thereof and a hole arranged at the center thereof; a T-shaped body including a circular base with longer diameter than the one of the hole and an assembling element vertically arranged on the circular base, having a first spindle hole arranged thereon, by which the T-shaped body is assembled upwards through the hole, leaving the circular base under the disc and therefore forming a rotatable assembly; a linking element with the upper section arranged as a cylinder having an upward opening for the bottom of a rotating rod to engage, the lower section arranged as a n-typed body having a second spindle hole and a third spindle hole on both sides correspondingly, and the space in-between to be inserted by the assembling element; a bolt linking the assembling element with the n-typed body by passing through the first, second, and third spindle hole, allowing the linking element to rotate on the disc;

wherein the rim of the hole has a loop formed in one-piece with a predetermined thickness protruding from the surface of the disc and having at least two stopping blocks, each includes a sloping first incline on the front and a vertical surface forming from the top of the first incline downwards to the surface of the loop; the n-typed body of the linking element is arranged correspondingly to the surface of the loop and the bottom of each stand thereof has an engaging block corresponding to the position of the stopping blocks with each engaging block including a bottom, a vertical stopping surface arranged at the front of the bottom, corresponding to the vertical surface, and a second incline arranged at the rear of the bottom, corresponding to the first incline of the stopping blocks; whereby the linking element is closely joined but movable with the engaging blocks as the bottom thereof abutting on the surface of the loop when the rotating rod is perpendicular to the disc, and when the bottom of the engaging blocks cannot abut on the surface of the loop, which causes slipping, the vertical surface at the rear of the stopping blocks would fix the position by abutting on the vertical stopping surface of the engaging blocks for the rotating rod to rotate with the mop head for dewatering by the centrifugal force; further, when the rotating rod is leaning, without the bottom of the engaging blocks abutting on the surface of the loop, the linking element is not closely joined with the engaging blocks, making the mop head rotatable and therefore easy for cleaning the floor.

As features disclosed above, in a preferred embodiment, the stopping blocks are arranged in a shape of a right triangle so that the first incline thereof and the second incline of the engaging blocks would match.

In a preferred embodiment, the assembling element of the T-shaped body further has a circular protrusion on the bottom periphery which has a shorter diameter than the one of the hole and the height thereof is shorter than the one of the loop.

In a preferred embodiment, the engaging blocks under the stands of the n-typed body are arranged in an L-shaped symmetrically.

In a preferred embodiment, the bottom of the disc has a flange for a circular frame with the cotton strips arranged thereon to engage by fitting the internal diameter thereof into the external edge of the flange.

With features disclosed above, the present invention has a structure to control the rotation of the mop head which is easier and more practical comparing to the structures according to the prior art. Also, the defect of inability to rotate the disc effectively due to long-term use is improved as well, ensuring the effectiveness of rinsing and cleaning, and longer the durability of the mop.

DETAILED DESCRIPTION OF THE PREFERRED EMBODIMENT

Figure 1:
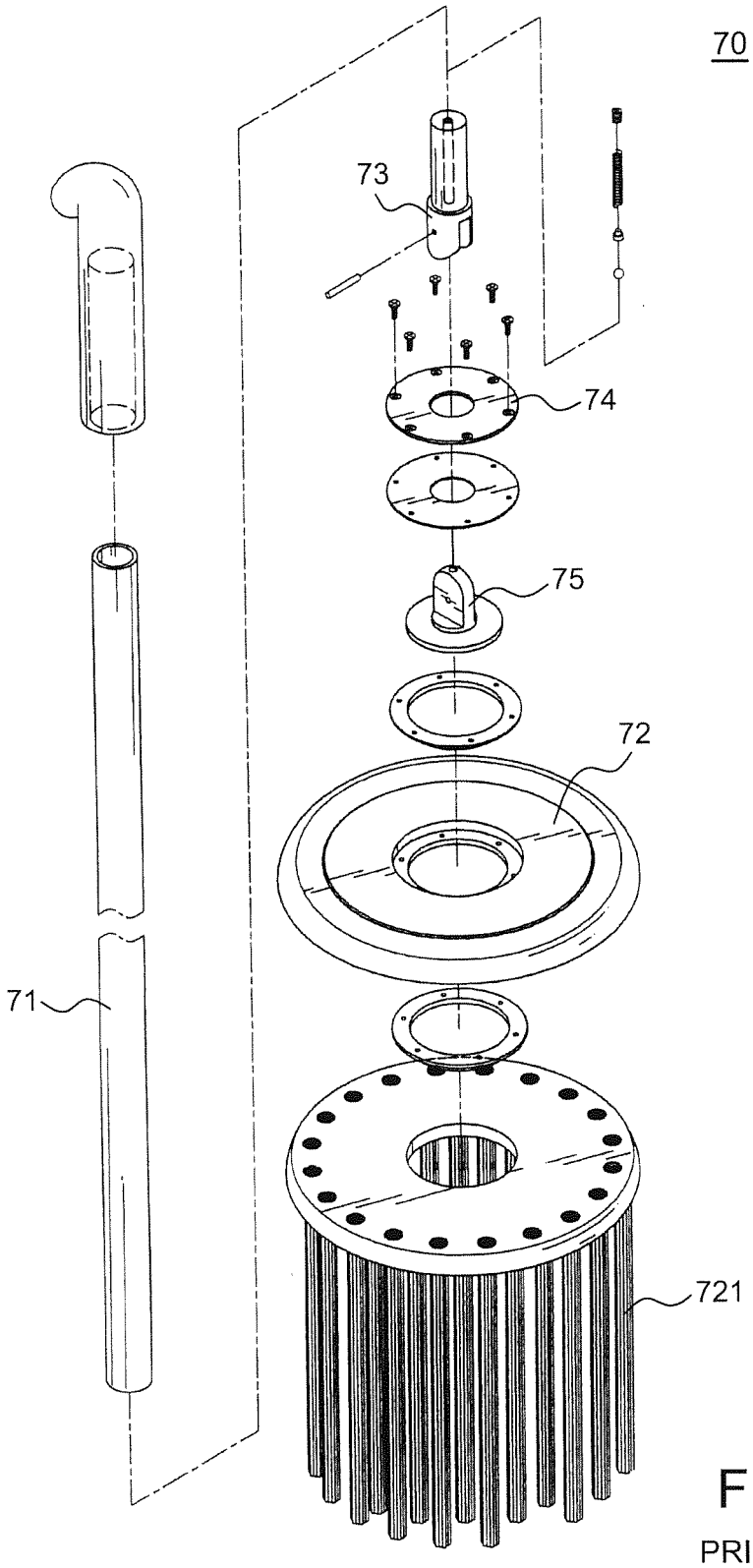
FIG.1 PRIOR ART
FIG. 1 is an exploded view of the invention from U.S. Pat. No. 7,540,057.
Figure 2:
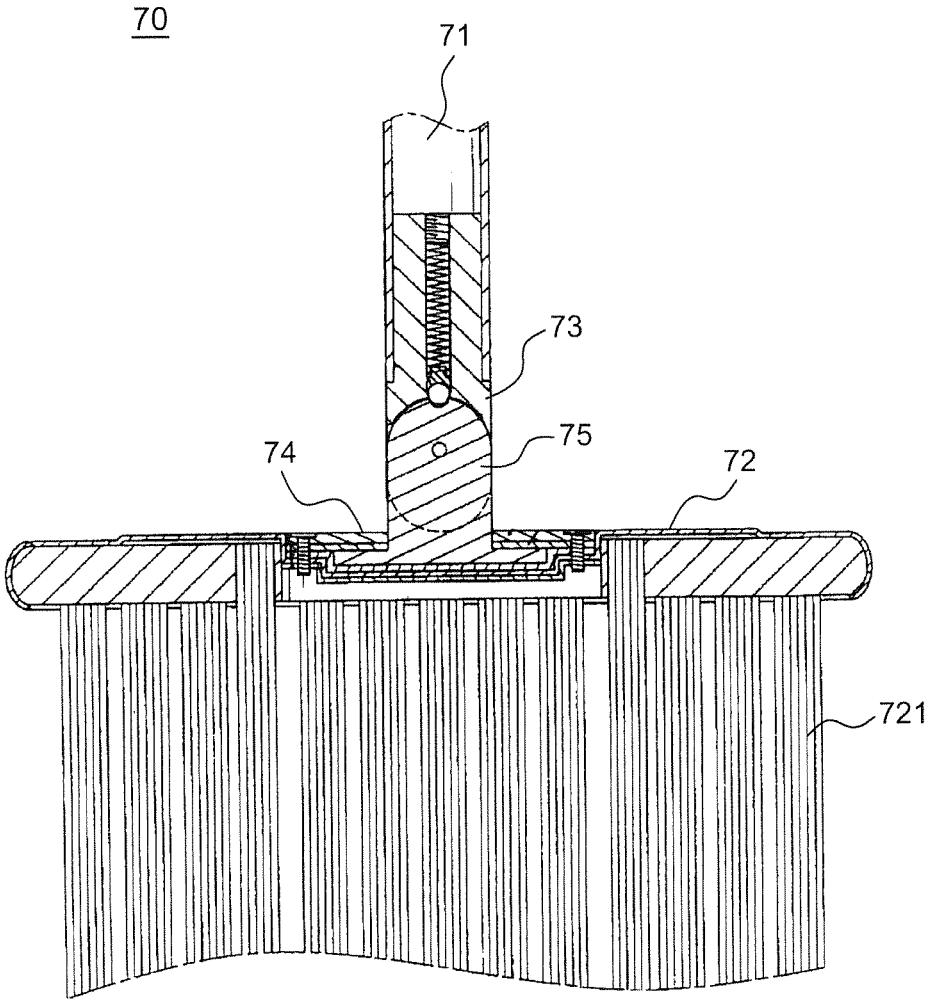
FIG.2 PRIOR ART
FIG. 2 is a sectional view of the invention from U.S. Pat. No. 7,540,057.

Referring to FIGS. 3-10, in a preferred embodiment, the present invention includes a mop head 10, a T-shaped body 20, a linking element 30 and a bolt 50.

The mop head 10 has a disc 11 having a plurality of cotton strips 12 arranged on the bottom periphery thereof and a hole 13 arranged at the center thereof. The T-shaped body 20 includes a circular base 21 with longer diameter than the one of the hole 13 and an assembling element 22 vertically arranged on the circular base 21. The assembling element 22 has a first spindle hole 23 arranged thereon, by which the T-shaped body 20 is assembled upwards through the hole 13, leaving the circular base 21 under the disc 11 and therefore forming a rotatable assembly.

The linking element 30 has its upper section arranged as a cylinder 31 with an upward opening for the bottom of a rotating rod 40 to engage and its lower section arranged as a n-typed body 32 with a second spindle hole 321 and a third spindle hole 322 on both sides correspondingly; the space 33 in-between is to be inserted by the assembling element 22. The bolt 50 links the assembling element 22 with the n-typed body 32 by passing through the first, second, and third spindle hole 23, 321, 322, allowing the linking element 30 to rotate on the disc 11.

Figure 3:
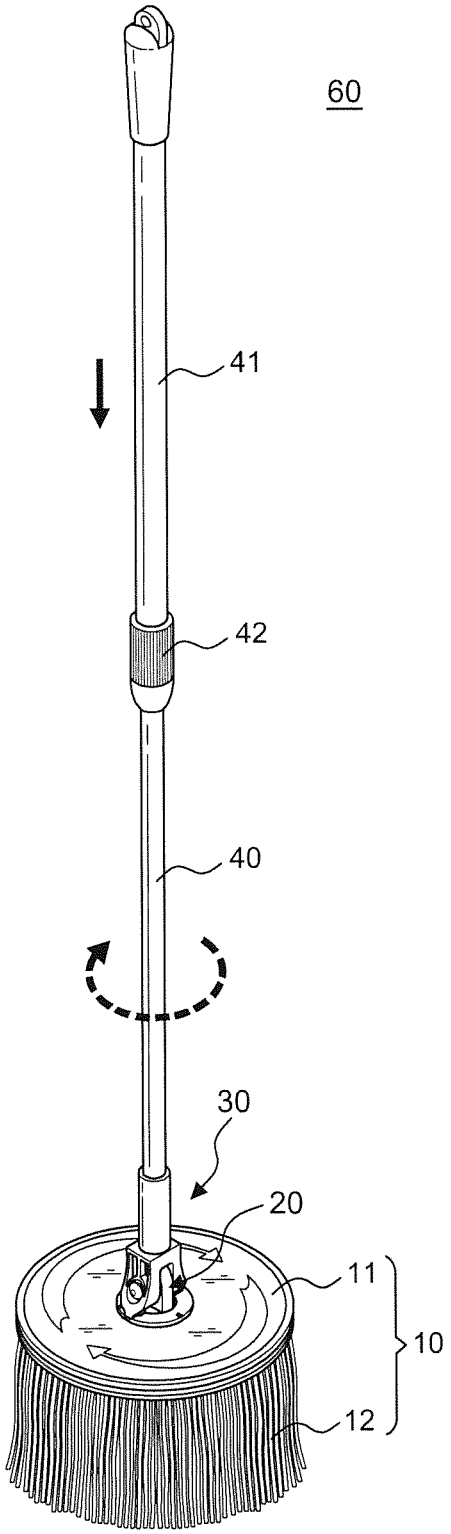
FIG. 3 is an exterior perspective view of the present invention in a preferred embodiment.

As shown in FIG. 3, an outer rod 41 and a locker 42 are arranged above the rotating rod 40. When the locker 42 is locked, the outer rod 41 cannot lengthen or shorten and the rotating rod 40 cannot rotate so that the rotating mop 60 can be used for mopping the floor. On the contrary, when the locker 42 is unlocked, the rotating mop 60 can be placed in a draining basket (not shown) and further drive the outer rod 41 to rotate the rotating rod 40 clockwise by vertical displacement of a driver, dewatering the cotton strips 12 by the centrifugal force. However, such structure is well known in the prior art already.

In this embodiment, the bottom of the disc 11 has a flange 111 for a circular frame 121 with the cotton strips 12 arranged thereon to engage by fitting the internal diameter 122 thereof into the external edge of the flange 111. Such design is easier for replacing the cotton strips 12 after showing wear and tear, and other components are still available for use, so as to avoid wastes of the components;

wherein the rim of the hole 13 has a loop 14 formed in one-piece with a predetermined thickness protruding from the surface of the disc 11 and having at least two (preferably three or four) stopping blocks 15, each includes a sloping first incline 151 on the front and a vertical surface 152 forming from the top of the first incline 151 downwards to the surface of the loop 14; in other words, the stopping blocks 15 are arranged as triangles.

Figure 4:
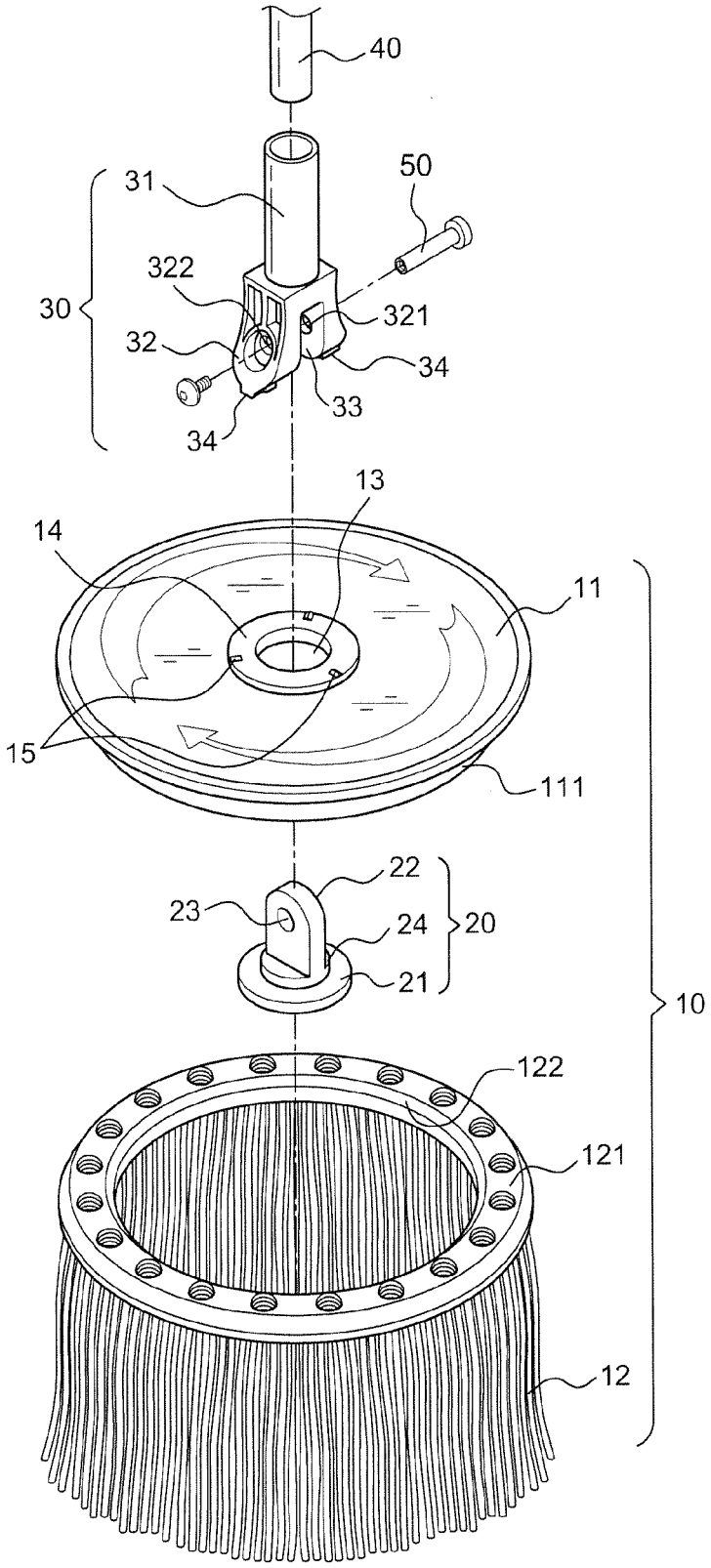
FIG. 4 is an exploded view of a major structure of the present invention.
Figure 5:
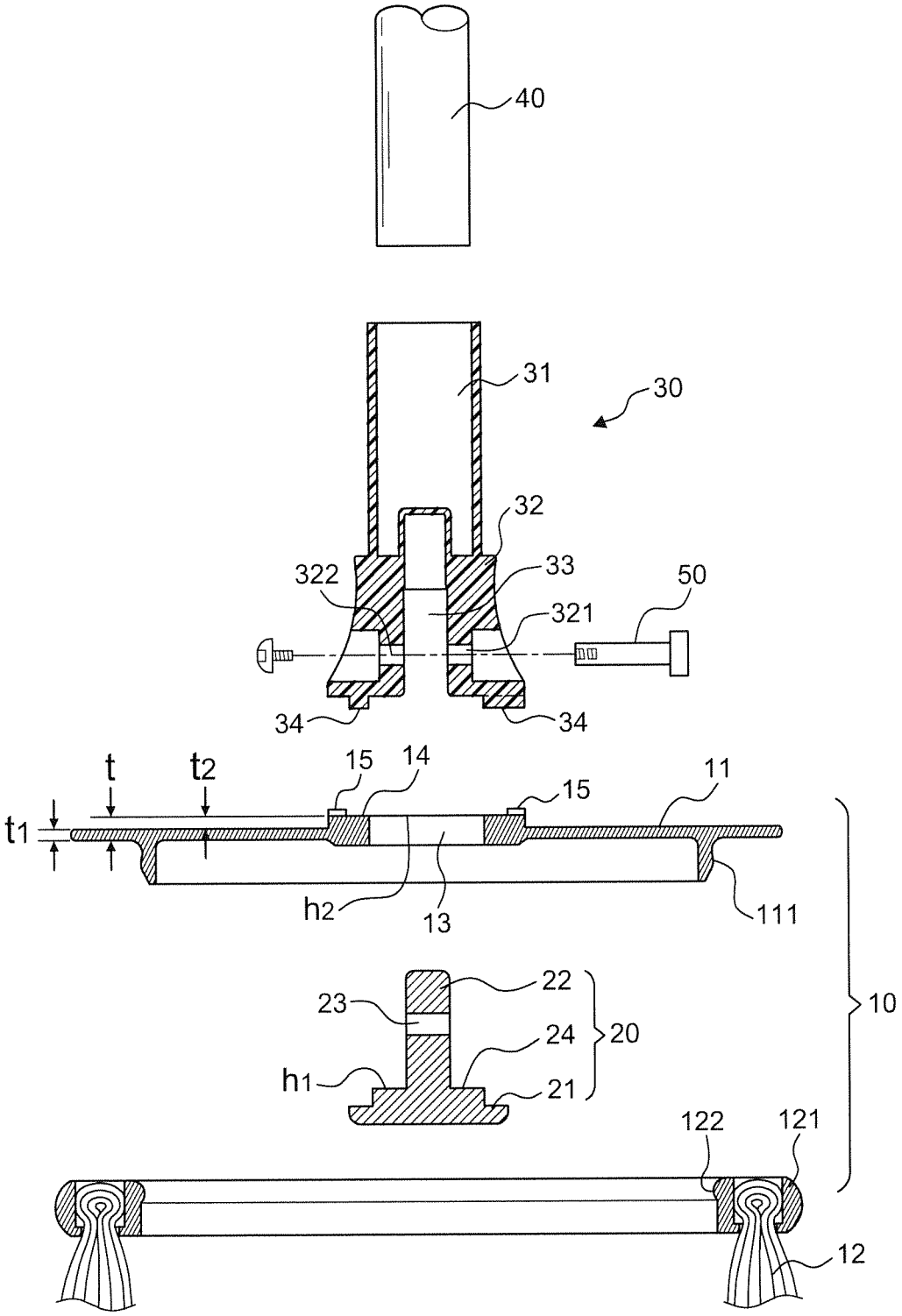
FIG. 5 is a sectional view of an exploded major structure of the present invention.

As shown in FIGS. 4 and 5, the thickness t1 of the disc 11 is about 1.5 to 2 mm. The disc 11 should be flexible so that the flange 111 thereof can engage with the circular frame 121 with the cotton strips 12. However, the wear-resistance would decrease with the flexibility and the disc 11 tends to deform or wear consequently. In this embodiment, the loop 14 protruding from the disc 11 in one-piece has a thickness t2 of 2 to 3 mm so that the total thickness T of the loop 14 together with the disc 11 would be about 5 mm, increasing the wear-resistance and further preventing the stopping blocks 15 on the surface of the loop 14 from deformation, but still, the disc 11 has certain flexibility with the thickness t1, especially the area around the edge.

Figure 6A:
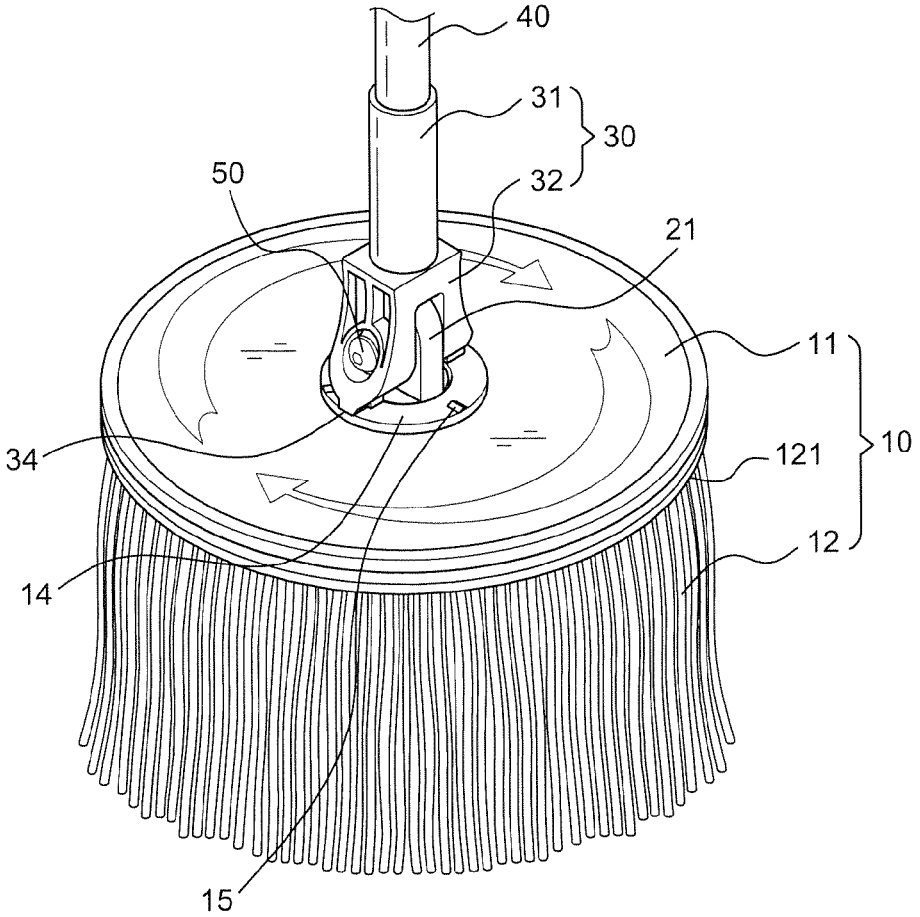
FIG. 6A is a practical application view of the present invention illustrating the rotating rod being perpendicular to the disc.
Figure 6B:
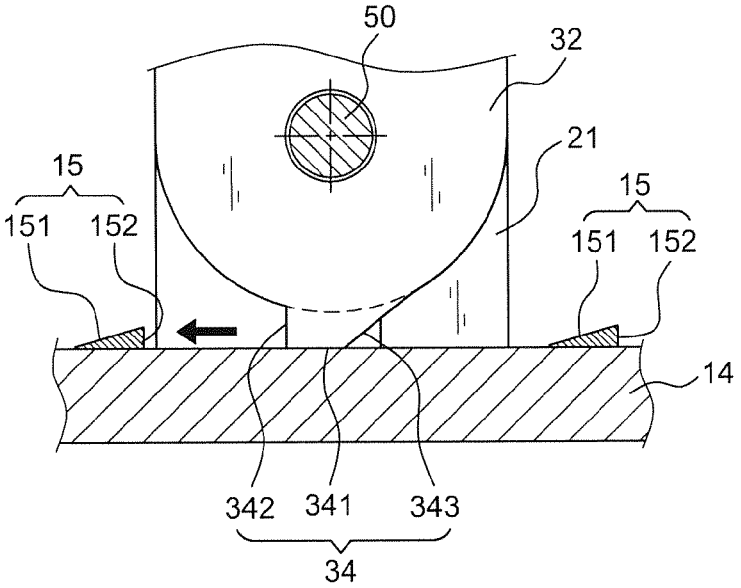
FIG. 6B is a schematic diagram illustrating the engagement of the stopping blocks and the engaging blocks in FIG. 6A.

Furthermore, the n-typed body 32 of the linking element 30 is arranged correspondingly to the surface of the loop 14 and the bottom of each stand thereof has an engaging block 34 corresponding to the position of the stopping blocks 15 with each engaging block 34 including a bottom 341, a vertical stopping surface 342 arranged at the front of the bottom 341, corresponding to the vertical surface 152, and a second incline 343 arranged at the rear of the bottom 341, corresponding to the first incline 151 of the stopping blocks 15;

whereby the linking element 30 is closely joined but movable with the engaging blocks 34 as the bottom 341 thereof abutting on the surface of the loop 14 when the rotating rod 40 is perpendicular to the disc 11, and when the bottom 341 of the engaging blocks 34 cannot abut on the surface of the loop 14, which causes slipping, the vertical surface 152 at the rear of the stopping blocks 15 would fix the position by abutting on the vertical stopping surface 342 of the engaging blocks 34 for the rotating rod 40 to rotate with the mop head 10 for dewatering by the centrifugal force as presented in FIGS. 6A and 6B.

Figure 7A:
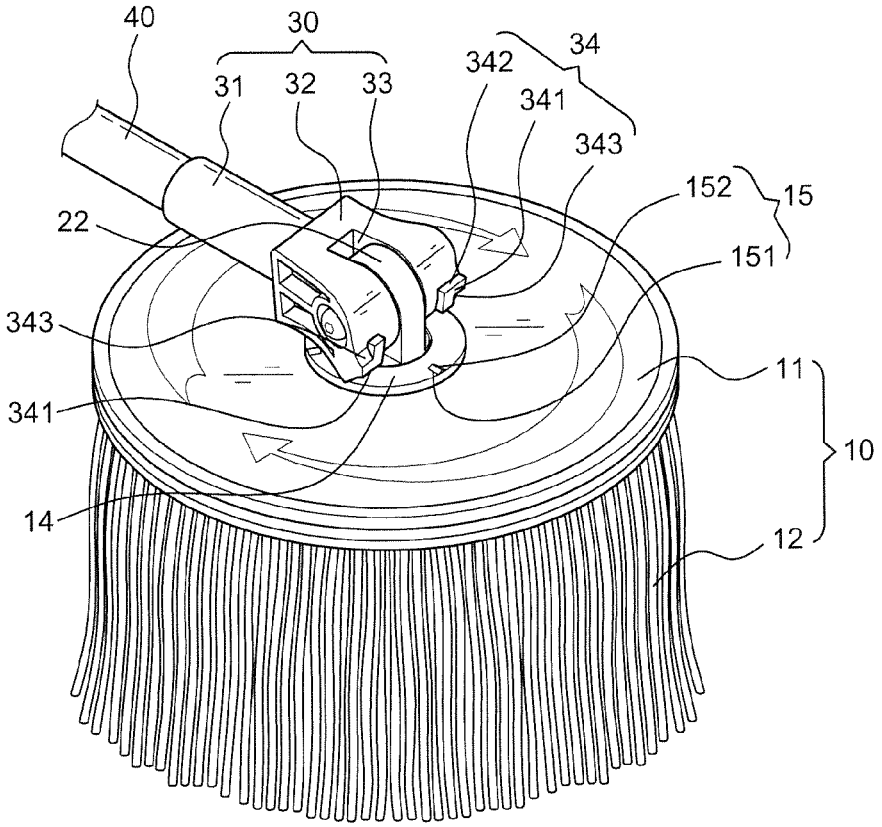
FIG. 7A is a practical application view of the present invention with the rotating rod leaning.
Figure 7B:
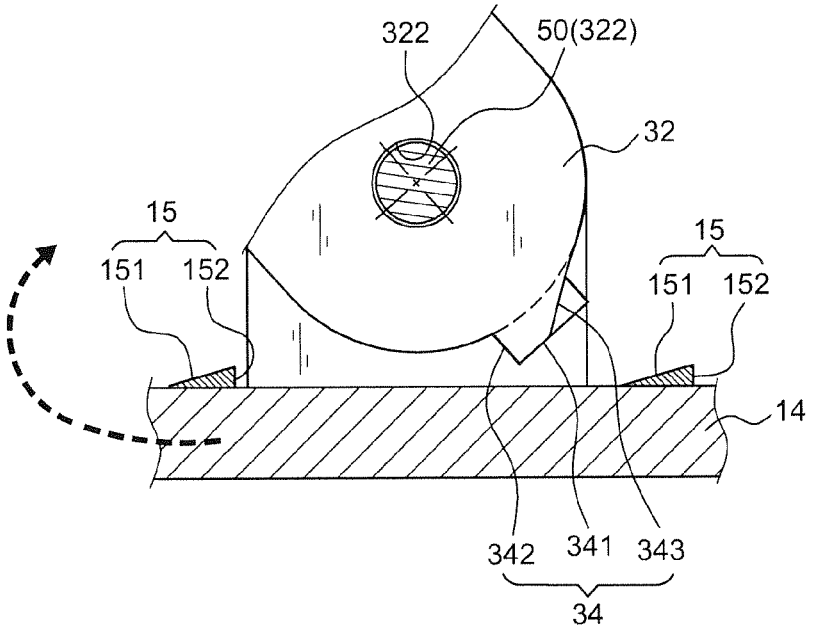
FIG. 7B is schematic diagram illustrating the linking element being separated from the engaging blocks in FIG. 7A.
Figure 8:
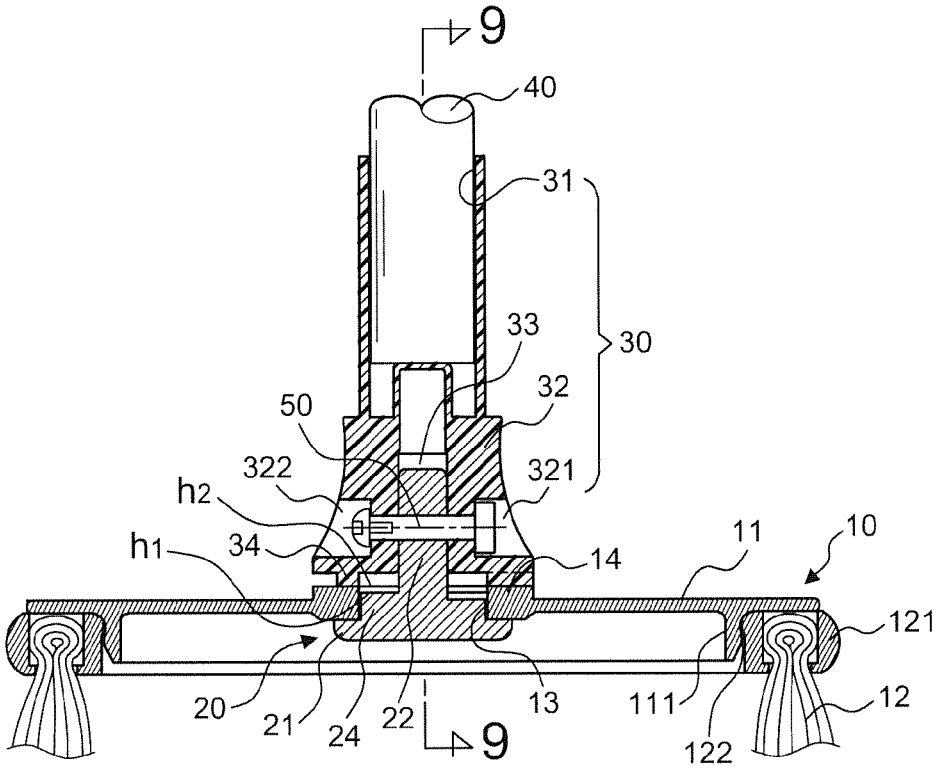
FIG. 8 is a sectional view of FIG. 6A, showing the rotating rod being perpendicular to the disc.
Figure 9:
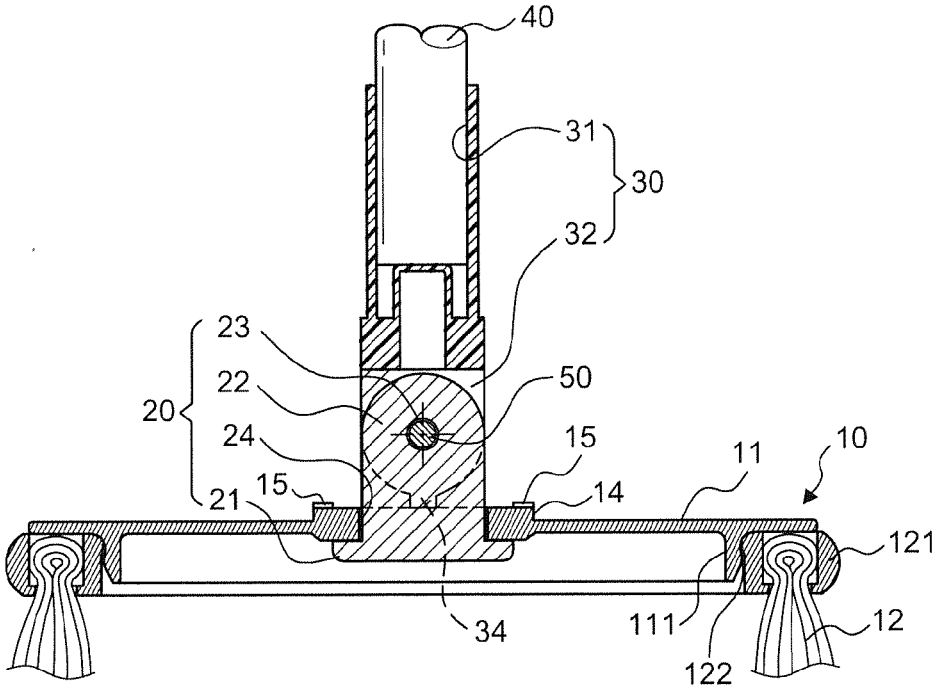
FIG. 9 is a cross-section view along line 9-9 in FIG. 8, showing the rotating rod being perpendicular to the disc.
Figure 10:
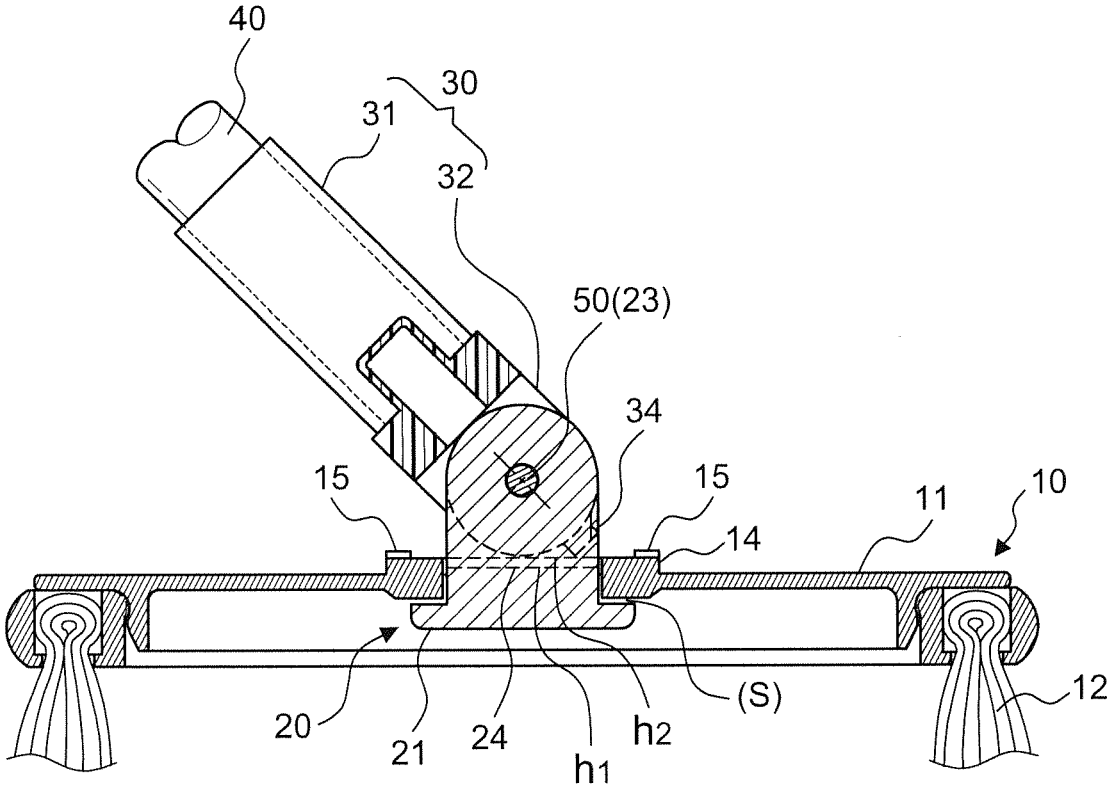
FIG. 10 is a schematic diagram of the present invention illustrating the rotating rod leaning.

Further, referring to FIGS. 7A and 7B, when the rotating rod 40 is leaning, without the bottom 341 of the engaging blocks 34 abutting on the surface of the loop 14, the linking element 30 is leaning and detached from the surface of the loop 14 as well, and the engaging blocks 34 would not be contacting the stopping blocks 15, making the mop head 10 rotatable and therefore easy for cleaning the floor. In this embodiment, the engaging blocks 34 under the stands of the n-typed body 32 are arranged in an L-shaped symmetrically and the second incline 343 thereof are arranged at the inner side of the L-shaped body so that the bottom 341 of the engaging blocks 34 has the largest contact area, allowing the engagement of the engaging blocks 34 and the surface of the loop 14 engaging close enough when the rotating rod 40 is perpendicular to the disc 11. Also, the arrangement of the second incline 343 has an advantage of damage-proofing.

Additionally, in this embodiment, the stopping blocks 15 are arranged in a shape of a right triangle so that the first incline 151 thereof is corresponding to the second incline 343 of the engaging blocks 34. Such design can adjust the engaging position when the engaging blocks 34 are right above the stopping blocks 15 as the leaning rotating rod 40 shown in FIG. 7A becoming perpendicular to the disc 11 as shown in FIG. 7B. With the corresponding design of the second incline 343 and the first incline 151, the engaging blocks 34 would not jam against the stopping blocks 15 and thus influence the rotating rod 40 becoming perpendicular or cause severe damages to the engaging blocks 34 and the stopping blocks 15.

Moreover, with reference to FIG. 5, in the embodiment the assembling element 22 of the T-shaped body 20 further has a circular protrusion 24 on the bottom periphery which has a shorter diameter than the one of the hole and the height h1 thereof is shorter than the one h2 of the loop 14. In this way, the T-shaped body 20 would operate more smoothly. Also, as in FIGS. 8 and 10, since the height h1 thereof is shorter than the height h2 of the loop 14, whether the rotating rod 40 is leaning or perpendicular, it would not affect the circular protrusion 24. In addition, referring to FIG. 10, when the rotating rod 40 is leaning, the engaging blocks 34 are separated from the surface of the loop 14, resulting the T-shaped body 20 not being pulled upwards by the n-typed body 32 and slightly descending. A narrow space S therefore appears between the bottom of the disc 11 and the slightly descending T-shaped body 20, with which the mop head 10 can rotate more smoothly.

With aforesaid structures and measures, the present invention has the L-shaped engaging blocks 34 under the stands of the n-shaped body 32 and multiple stopping blocks 15 on the surface of the loop 14 operate correspondingly to control the rotation of the mop head 10 which is easier and more practical comparing to the structures according to the prior art. Also, the defect of inability to rotate the disc effectively due to long-term use is improved as well, ensuring the effectiveness of rinsing and cleaning, and longer the durability of the mop.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A confining structure of a rotating mop comprising:

a mop head with a disc having a plurality of cotton strips arranged on the bottom periphery thereof and a hole arranged at the center thereof;

a T-shaped body including a circular base with longer diameter than the one of the hole and an assembling element vertically arranged on the circular base, having a first spindle hole arranged thereon, by which the T-shaped body is assembled upwards through the hole, leaving the circular base under the disc and therefore forming a rotatable assembly;

a linking element with the upper section arranged as a cylinder having an upward opening for the bottom of a rotating rod to engage, the lower section arranged as a n-typed body having a second spindle hole and a third spindle hole on both sides correspondingly, and the space in-between to be inserted by the assembling element;

a bolt linking the assembling element with the n-typed body by passing through the first, second, and third spindle hole, allowing the linking element to rotate on the disc;

wherein a rim of the hole has a loop formed in one-piece with a predetermined thickness protruding from the surface of the disc and having at least two stopping blocks, each includes a sloping first incline on the front and a vertical surface forming from the top of the first incline downwards to the surface of the loop;

the n-typed body of the linking element is arranged correspondingly to the surface of the loop and a bottom of each stand thereof has an engaging block corresponding to the position of the stopping blocks with each engaging block including a bottom, a vertical stopping surface arranged at the front of the bottom, corresponding to the vertical surface, and a second incline arranged at the rear of the bottom, corresponding to the first incline of the stopping blocks;

whereby the linking element is closely joined but movable with the engaging blocks as the bottom thereof abutting on the surface of the loop when the rotating rod is perpendicular to the disc, and when the bottom of the engaging blocks cannot abut on the surface of the loop, which causes slipping, the vertical surface at the rear of the stopping blocks would fix the position by abutting on the vertical stopping surface of the engaging blocks for the rotating rod to rotate with the mop head for dewatering by the centrifugal force; further, when the rotating rod is leaning, without the bottom of the engaging blocks abutting on the surface of the loop, the linking element is not closely joined with the engaging blocks, making the mop head rotatable and therefore easy for cleaning the floor.

2. The confining structure of a rotating mop as claimed in claim 1, wherein the stopping blocks are arranged in a shape of a right triangle so that the first incline thereof and the second incline of the engaging blocks would match mutually.

3. The confining structure of a rotating mop as claimed in claim 1, wherein the assembling element of the T-shaped body further has a circular protrusion on the bottom periphery which has a shorter diameter than the one of the hole and the height thereof is shorter than the one of the loop.

4. The confining structure of a rotating mop as claimed in claim 1, wherein the engaging blocks under the stands of the n-typed body are arranged in an L-shaped symmetrically.

5. The confining structure of a rotating mop as claimed in claim 1, wherein the bottom of the disc has a flange for a circular frame with the cotton strips arranged thereon to engage by fitting the internal diameter thereof into the external edge of the flange.

* * * * *